United States Patent [19]

Cheney

[11] 4,135,530

[45] Jan. 23, 1979

[54] RINSING TANK

[75] Inventor: Bruce R. Cheney, Vernon, Conn.

[73] Assignee: Litton Industrial Products, Inc., East Hartford, Conn.

[21] Appl. No.: 613,572

[22] Filed: Sep. 15, 1975

[51] Int. Cl.[2] ..... B08B 3/04

[52] U.S. Cl. ..... 134/60; 134/91; 134/104; 134/182; 137/574; 210/221 R

[58] Field of Search ..... 134/60, 84–85, 134/88, 91–92, 154, 182–183, 104, 201, 109–111; 137/574; 210/221 R

[56] References Cited

U.S. PATENT DOCUMENTS

| | | | |
|---|---|---|---|
| 240,404 | 4/1881 | Gibbs | 134/110 X |
| 592,721 | 10/1897 | Barnhart | 137/574 X |
| 1,045,079 | 11/1912 | Prunier et al. | 134/60 UX |
| 1,190,638 | 7/1916 | Furman | 134/104 UX |
| 3,028,267 | 4/1962 | Edhofer et al. | 134/84 X |
| 3,938,214 | 2/1976 | Hodsden et al. | 134/60 X |

*Primary Examiner*—Robert L. Bleutge

*Attorney, Agent, or Firm*—Joseph R. Spalla

[57] ABSTRACT

A rinsing tank constructed to allow low volume water flow from an ingress point at one end of the tank to an outlet. Weirs are provided in the path of water flow to normally dam scum driven by the water flow yet allow passage of water. The rinsing water is, therefore, free of scum over a major part of its surface to permit immersion into and withdrawal from clear water of parts to be rinsed. Immersion of parts raises the water level in the tanks whereby scum dammed by the weirs can rise and pass over the weirs to the tank outlet.

4 Claims, 2 Drawing Figures

RINSING TANK

Figure 1:
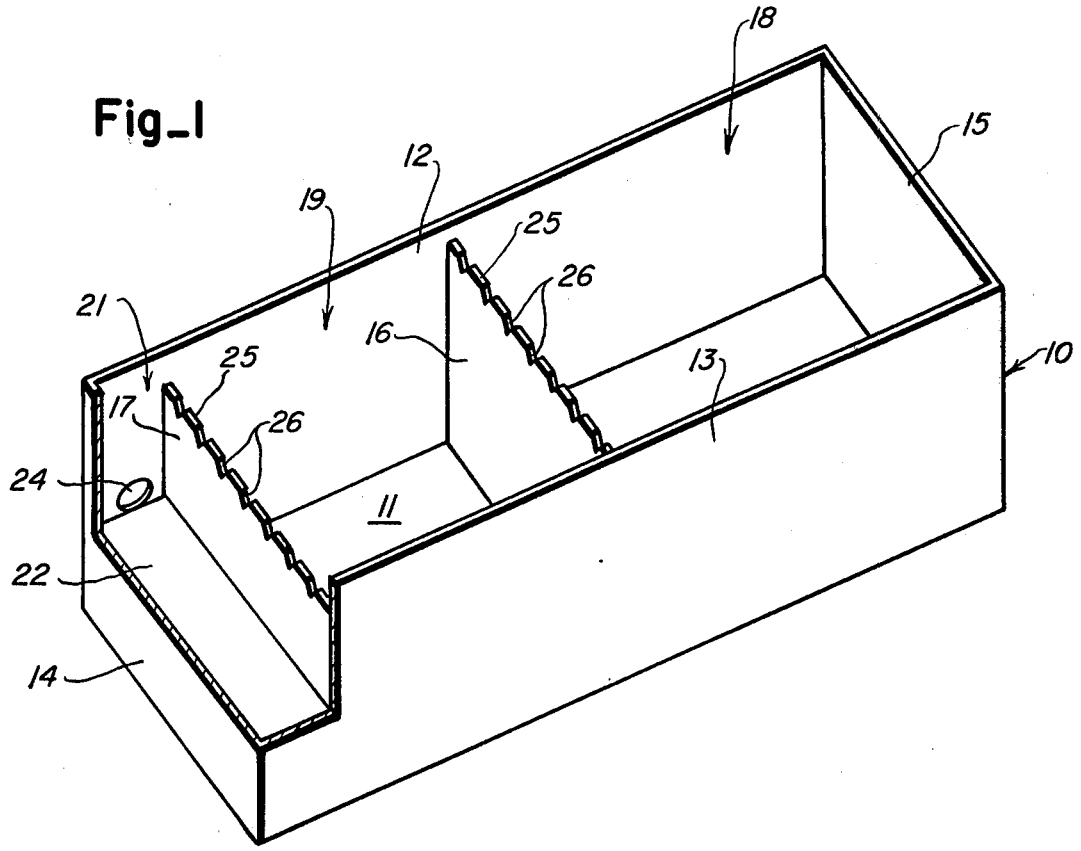

This invention relates to rinsing tanks; more particularly, it relates to rinsing tanks having weirs intermediate the inlet and outlet ends of the tanks, and specifically, it relates to rinsing tanks having weirs which permit water flow yet block the passage of floating scum.

Rinsing tanks are employed in a number of applications to rinse off acids, alkalies, coating solution residues or dye residues. Materials rinsed off take the form of scum which floats to the surface of the rinse water and sediment which sinks to the bottom of the tank. The object sought is to assure that materials rinsed off parts, particularly floating scum, be prevented from adhering to parts to be subsequently rinsed and from readhering to parts during removal from the rinse water. Rinse tanks in the prior art have attempted to meet the above stated object by continually moving large wasteful volumes of water through the rinse tank to carry away scum. The movement of large volumes of water, however, creates turbulence which causes sediment as well as scum to be held suspended and occupy all of the volume of rinse water. Under this set of conditions, unless the volume changes rapidly, parts to be rinsed, immersed into and removed from such rinse water are likely to be dirty.

In accordance with the present invention, there is provided a rinsing tank having an inlet end, a final rinse section, a first rinse section and an outlet section. The downstream boundaries of the sections are defined by weirs with the weir between the final and first sections at a higher level than the weir between the first and outlet sections. A controlled, low volume of water entering the final rinse section causes a flow of water over the edges of the weirs. Scum is, therefore, carried toward the weirs which are constructed to block flow of scum between sections yet allow controlled flow of clear fluid between sections. Immersion of parts to be cleaned, in the first lower fluid level rinse section and then in the final higher level rinse section, raises water levels to permit flow over the edges of the weirs whereby scum can move downstream. In accordance with the invention, the flow rate is controlled to be sufficient to move scum to the weirs while maintaining the major portion of the surface area of the rinse tank free of scum.

An object of the invention is to provide a rinse tank containing a fluid whose surface is maintained substantially free of floating scum.

Another object of the invention is in the provision of a rinse tank which requires low flow rates of rinsing water.

Another object of the invention is to provide a method of rinsing wherein the volume of rinsing water is kept to a minimum and the rinsing water is maintained substantially free of scum and sediment.

Figure 2:
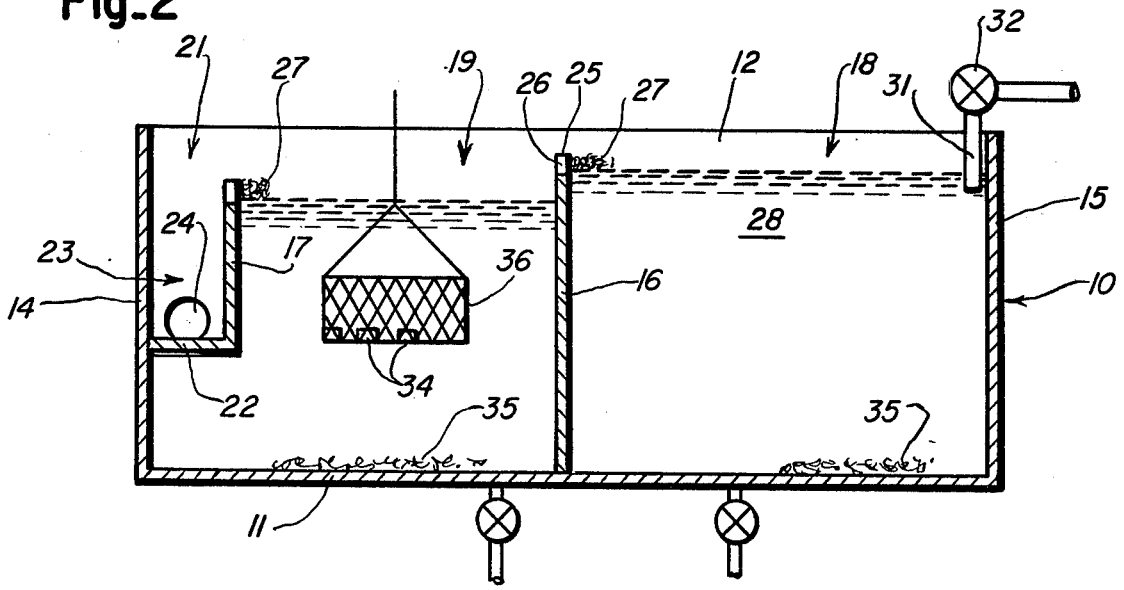

Other objects and many of the attendant advantages of this invention will be readily appreciated as the same becomes better understood by reference to the following detailed description when considered in connection with the accompanying drawing wherein like reference numerals designate like or corresponding parts throughout the several views and wherein:

FIG. 1 is a perspective view of a rinsing tank constructed in accordance with the invention; and FIG. 2 is a side elevational view of a tank as shown in FIG. 1.

Referring now to the drawing wherein like reference numerals designate like or corresponding parts throughout the several views, there is shown in FIG. 1 a generally rectangular tank 10 having bottom 11, side 12, 13 and end walls 14, 15. The tank 10 is compartmented between the end walls 14, 15 by a first weir 16 and a second weir 17, both parallel to the end walls 14, 15, thereby defining a final rinse section generally designated by reference numeral 18, a first rinse section generally designated by reference numeral 19 and an outlet section 21. As shown in FIGS. 1 and 2, the first weir 16 is secured as by welding to the side walls 12, 13 and to the bottom wall 11 while the second weir 17 is secured as by welding to side walls 12, 13 and to a plate 22, substantially parallel to and spaced above the bottom wall 11, which is secured to the side walls 12, 13 and to the end wall 15, thereby defining with the weir 17 a trough generally designated by reference numeral 23 which directs flow to an outlet 24 in the side wall 12 of the tank 10. Plate 22 is preferably slightly inclined toward outlet 24.

As viewed in FIG. 1, the upper edges 25 of the weirs 16 and 17 have slots in the form of notches 26 at intervals sufficient at a controlled flow rate to achieve a laminar or smooth flow from section 18 to section 19 across the width of the tank 10 which has been previously levelled thus to carry scum 27, floating in each section, toward the weirs 16, 17.

As particularly viewed in FIG. 2, rinsing water or other rinsing fluid 28 is introduced into final rinse section 18 through an inlet pipe 31 located adjacent end wall 15 of the tank 10. Further, as viewed in FIG. 2, the first weir 16 extends vertically higher than the second weir 17 a predetermined distance. In accordance with the invention, the rate of flow from inlet 31, determined by a valve 32, is established to maintain the water levels below the top edges 25 of the weirs 16, 17 yet higher than the bottom 33 of the notches 26 and sufficient to move any scum 27 in tank sections 18, 19 toward the weirs 16, 17. Thus, scum will be arrested by and accummulated at the weirs 16, 17 with clear fluid 28 below the scum 27 being allowed to pass through the notches 26 in the weirs 16, 17. Thus, the notched weirs constitute flow control means. The fluid levels in the tank 10 with no parts 34 immersed is shown in FIG. 2 with scum 27 accummulated at the weirs 16, 17, sediment 35 at the tank bottom and with a flow of clear fluid 28 moving from immersed inlet 31 to outlet 24 close to the surface of the fluid.

When parts 34 to be cleaned are immersed, typically the parts supported by a basket 36 will be first immersed in the first rinse section 19 adjacent the outlet section 21, the fluid 28 displaced will cause the fluid level in the first rinse section 19 to rise with the result that the accummulated scum 27 at the weir 17 will pass over into the outlet section 21. Due to the fact that weir 16 is higher, no overflow of fluid will pass from first rinse section 19 to final rinse section 18. After rinsing in section 19, the parts 34 will then be immersed in final rinse section 18 with any accummulated scum 27 at weir 16 passing into the lower level rinse section 19 to be accummulated at weir 17. Thus, the immersion and withdrawals of parts 34 is through a fluid surface which is substantially free of floating scum.

The invention claimed is:

1. A rinsing tank comprising at least one rinse section and an outlet section, a weir separating said sections having an upper edge, means for introducing a positive continuous flow of rinse fluid into said rinsing tank on the side of said rinse section farthest upstream from said weir, said weir having a plurality of flow control passages spaced along and extending from said upper edge to permit smooth passage of rinse fluid below the level of the upper edge of said weir, and means to establish a rate of flow to maintain rinse fluid movement at a level below the upper edge of said weir, whereby floating scum continuously moves toward and is accumulated and held back by said weir with the major portion of the surface area of said rinse section free of scum, said accumulated floating scum being movable over the upper edge of said weir when parts are immersed in said rinse section and raise the rinse fluid level above the upper edge of said weir.

2. A rinsing tank as recited in claim 1, said flow control passages comprising a plurality of V-shaped notches.

3. A rinsing tank as recited in claim 1, including a second rinse section upstream of said one rinse section, and a second weir having an upper edge between said rinse sections, said second weir having a plurality of flow control passages to said outlet section extending below the upper edge thereof.

4. A rinsing tank as recited in claim 3 said second weir having an upper edge at a higher elevation than the upper edge of said first weir between said one rinse section and said outlet sections.

* * * * *